US012650268B2

(12) United States Patent
Vakhshouri et al.

(10) Patent No.: US 12,650,268 B2
(45) Date of Patent: Jun. 9, 2026

(54) HEAT PIPES AND VAPOR CHAMBERS MANUFACTURED USING A VACUUM PROCESS

(71) Applicant: Meta Platforms Technologies, LLC, Menlo Park, CA (US)

(72) Inventors: Kiarash Vakhshouri, Daly City, CA (US); Ustun Duman, Palo Alto, CA (US); Michael Nikkhoo, Saratoga, CA (US)

(73) Assignee: Meta Platform Technologies, LLC, Menlo Park, CA (US)

( * ) Notice: Subject to any disclaimer, the term of this patent is extended or adjusted under 35 U.S.C. 154(b) by 167 days.

(21) Appl. No.: 18/233,224

(22) Filed: Aug. 11, 2023

(65) Prior Publication Data

US 2024/0077259 A1 Mar. 7, 2024

Related U.S. Application Data

(60) Provisional application No. 63/404,500, filed on Sep. 7, 2022.

(51) Int. Cl.
*F28D 15/02* (2006.01)
*F28F 19/04* (2006.01)

(52) U.S. Cl.
CPC ..... *F28D 15/02* (2013.01); *F28F 19/04* (2013.01); *F28F 2245/02* (2013.01); *F28F 2245/04* (2013.01)

(58) Field of Classification Search
CPC ..... F28D 15/02; F28D 15/046; F28D 15/025; F28F 19/04; F28F 2245/04; F28F 2245/02
See application file for complete search history.

(56) References Cited

U.S. PATENT DOCUMENTS

| | | | |
|---|---|---|---|
| 4,489,777 | A | 12/1984 | Del Bagno et al. |
| 4,541,261 | A | 9/1985 | Yanadori et al. |
| 5,218,516 | A | 6/1993 | Collins et al. |
| 8,037,927 | B2 | 10/2011 | Schuette |

(Continued)

FOREIGN PATENT DOCUMENTS

| | | |
|---|---|---|
| CN | 104439708 B | 9/2016 |
| CN | 109127330 A | 1/2019 |

(Continued)

OTHER PUBLICATIONS

European Search Report for European Patent Application No. 23195617.8 dated Jan. 11, 2024, 03 pages.

(Continued)

*Primary Examiner* — Harry E Arant
(74) *Attorney, Agent, or Firm* — McDermott Will & Schulte LLP

(57) ABSTRACT

A heat pipe comprises a first substrate and an evaporator portion comprising a plurality of raised features on a surface of the first substrate. The heat pipe also comprises a condenser portion including a coating of an organic compound on the surface of the first substrate, wherein the coating of the organic compound on the surface of the first substrate in the condenser portion has a carbon content in a range of 1% to 15%. The heat pipe further comprises a second substrate bonded to the first substrate and a working fluid between the first substrate and the second substrate.

20 Claims, 7 Drawing Sheets

(56) References Cited

U.S. PATENT DOCUMENTS

| | | | | |
|---|---|---|---|---|
| 9,222,735 | B2 | 12/2015 | Hill et al. | |
| 9,295,185 | B2 | 3/2016 | Icoz et al. | |
| 10,876,193 | B2 | 12/2020 | Guo et al. | |
| 11,243,032 | B2 | 2/2022 | Miers et al. | |
| 2004/0218367 | A1 | 11/2004 | Lin et al. | |
| 2006/0151153 | A1* | 7/2006 | Chen | F28D 15/02 165/905 |
| 2006/0157227 | A1 | 7/2006 | Choi et al. | |
| 2006/0162907 | A1 | 7/2006 | Wu et al. | |
| 2006/0283575 | A1 | 12/2006 | Pai | |
| 2007/0193722 | A1 | 8/2007 | Hou et al. | |
| 2007/0240858 | A1 | 10/2007 | Hou et al. | |
| 2013/0180593 | A1* | 7/2013 | Gupta | F28D 15/046 165/104.26 |
| 2013/0327504 | A1 | 12/2013 | Bozorgi et al. | |
| 2016/0076820 | A1 | 3/2016 | Lewis et al. | |
| 2016/0161193 | A1* | 6/2016 | Lewis | B23P 15/26 216/13 |
| 2016/0212889 | A1 | 7/2016 | Nikkhoo et al. | |
| 2017/0184863 | A1 | 6/2017 | Balachandreswaran et al. | |
| 2018/0307282 | A1 | 10/2018 | Allin et al. | |
| 2018/0356156 | A1 | 12/2018 | Hurbi et al. | |
| 2019/0116691 | A1 | 4/2019 | Bozorgi | |
| 2019/0186842 | A1 | 6/2019 | Chiang | |
| 2019/0204020 | A1 | 7/2019 | Liu et al. | |
| 2019/0227329 | A1 | 7/2019 | Han et al. | |
| 2019/0271510 | A1 | 9/2019 | Yang | |
| 2019/0285353 | A1 | 9/2019 | Sheng | |
| 2019/0319152 | A1 | 10/2019 | Guo et al. | |
| 2020/0093034 | A1 | 3/2020 | Taylor et al. | |
| 2020/0339423 | A1* | 10/2020 | Lin | H05K 7/20336 |
| 2020/0398652 | A1 | 12/2020 | Stephens et al. | |
| 2021/0071963 | A1 | 3/2021 | Hulse et al. | |

FOREIGN PATENT DOCUMENTS

| | | | | |
|---|---|---|---|---|
| CN | 111879158 | A * | 11/2020 | F28D 15/046 |
| CN | 112119277 | A | 12/2020 | |
| JP | 2010096405 | A * | 4/2010 | F28D 15/048 |
| WO | 2020061267 | A9 | 7/2020 | |
| WO | 2022066806 | A1 | 3/2022 | |

OTHER PUBLICATIONS

Final Office Action mailed Dec. 29, 2023 for U.S. Appl. No. 17/559,883, filed Dec. 22, 2021, 25 pages.
Machine Translation of CN111879158A, 2020, 11 pages.
Non-Final Office Action mailed Aug. 2, 2023 for U.S. Appl. No. 17/559,883, filed Dec. 22, 2021, 22 bages.

* cited by examiner

HEAT PIPES AND VAPOR CHAMBERS MANUFACTURED USING A VACUUM PROCESS

CROSS-REFERENCE TO RELATED APPLICATIONS

This application claims priority to U.S. Provisional Application No. 63/404,500, filed on Sep. 7, 2022, which is incorporated herein by reference.

BACKGROUND

Recent advances in battery technology have enabled computationally powerful portable electronic devices, which generate considerable amounts of heat. The increased heat generated by these devices, coupled with the continual demand for smaller and lighter devices makes it difficult to adequately dissipate heat from the portable electronic devices or to achieve isothermal conditions. Heat pipes and vapor chambers are useful means to spread and/or dissipate heat in an electronic device. However, existing heat pipes and vapor chambers are available in limited sizes, shapes, materials, and configurations, and conventional techniques for manufacturing heat pipes and vapor chambers make their construction complicated, time consuming, and costly.

In particular, processing and creating the right wetting surface for heat pipes and vapor chambers is very crucial. On the evaporator side of the heat pipes and vapor chambers, hydrophilic surfaces are needed and on the condenser side, hydrophobic/superhydrophobic surfaces are needed for efficient heat transfer. One of the main challenges in heat pipe manufacturing is to have the right processing conditions to create both hydrophobic and hydrophilic surfaces.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Overview

Figure 1:
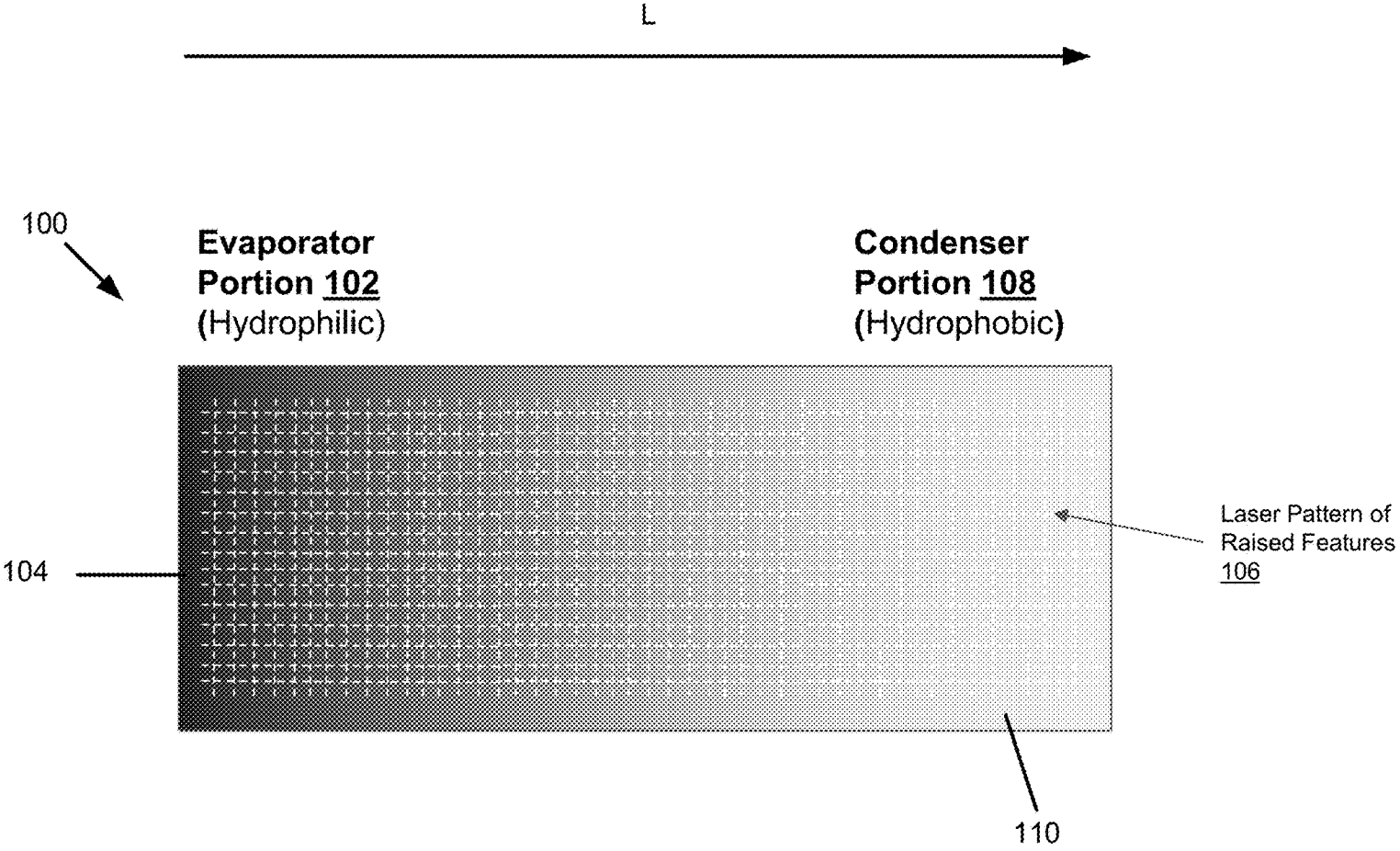
FIG. 1 schematically illustrates a substrate for a heat pipe or vapor chamber, in accordance with an example of the present disclosure.
Figure 2A:
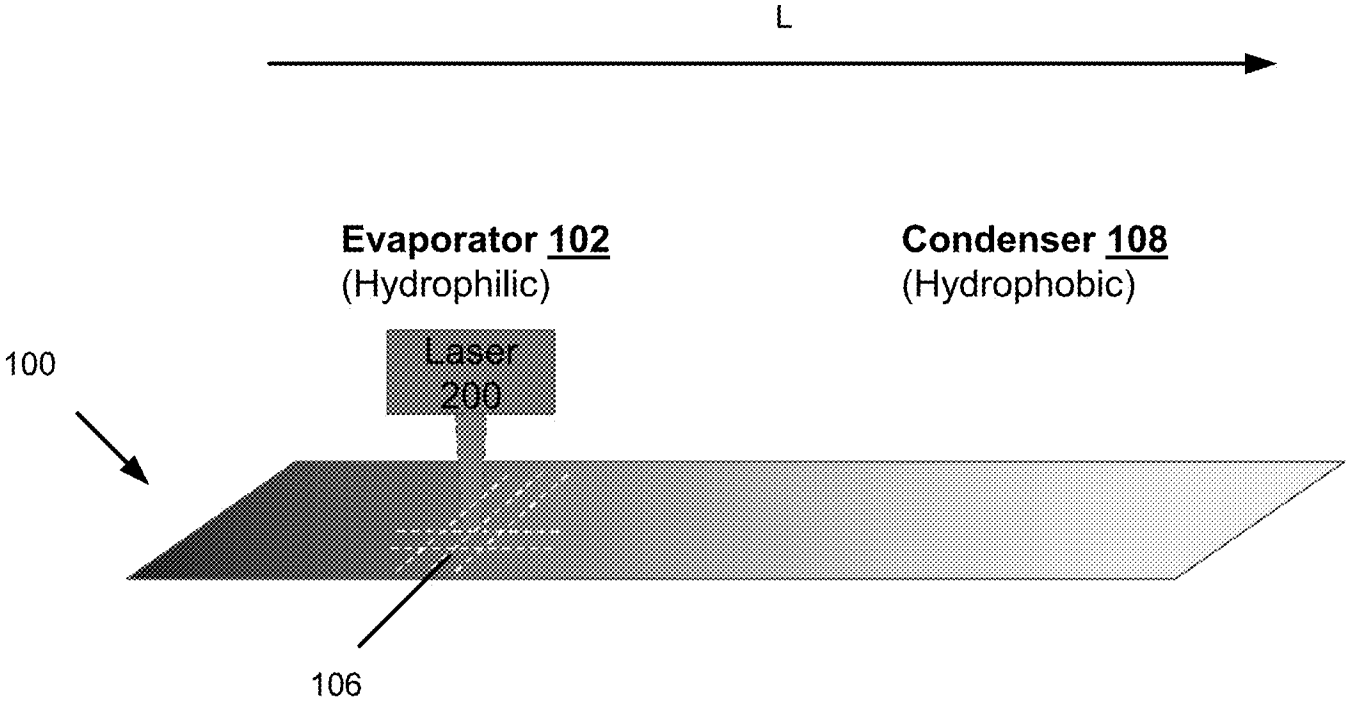
FIGS. 2A-2D schematically illustrate the substrate of FIG. 1 and a heat pipe or vapor chamber including the substrate of FIG. 1 in various stages of manufacture, in accordance with an example of the present disclosure.
Figure 2B:
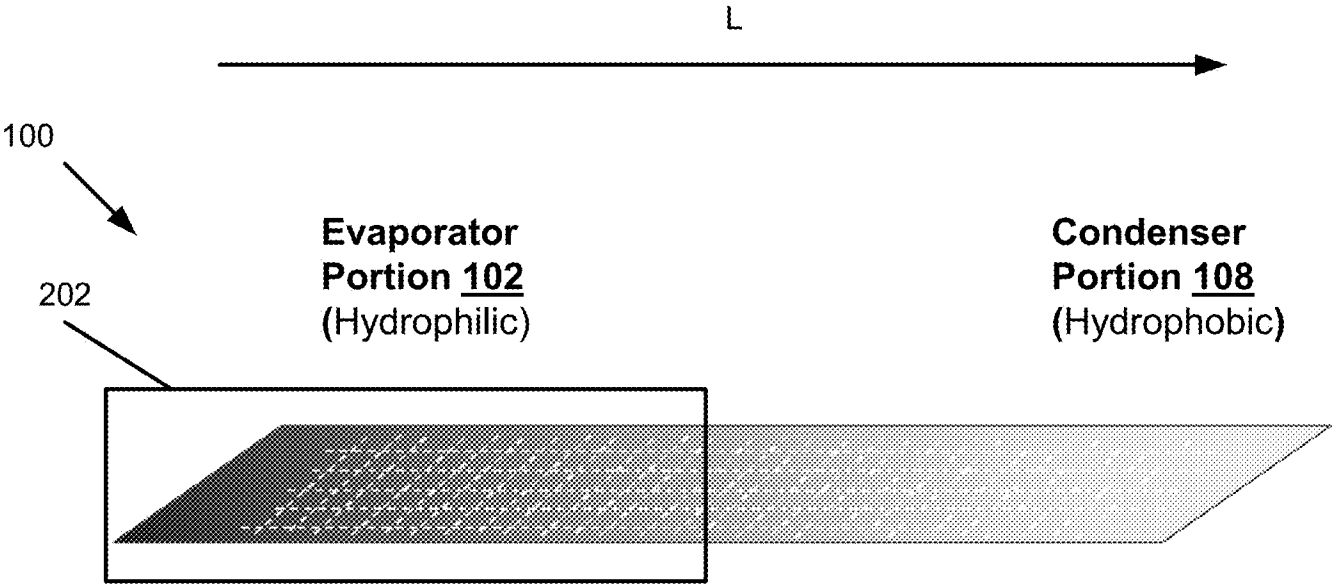
Figure 2C:
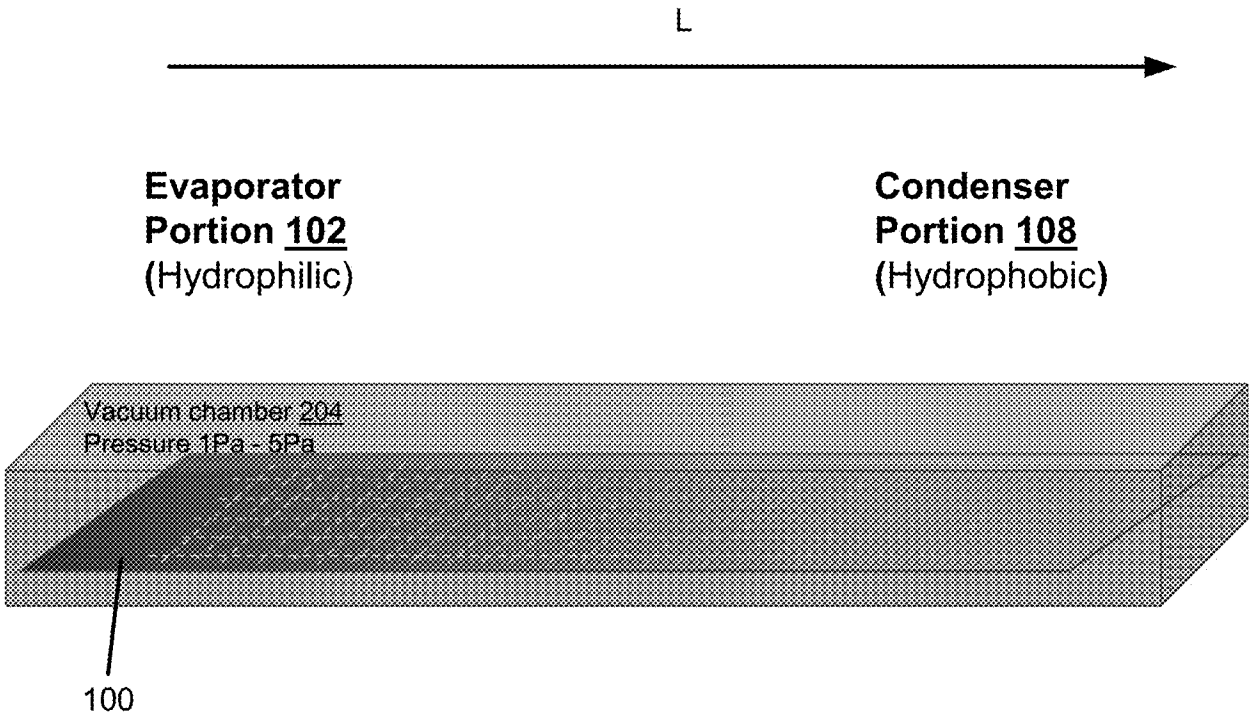
Figure 2D:
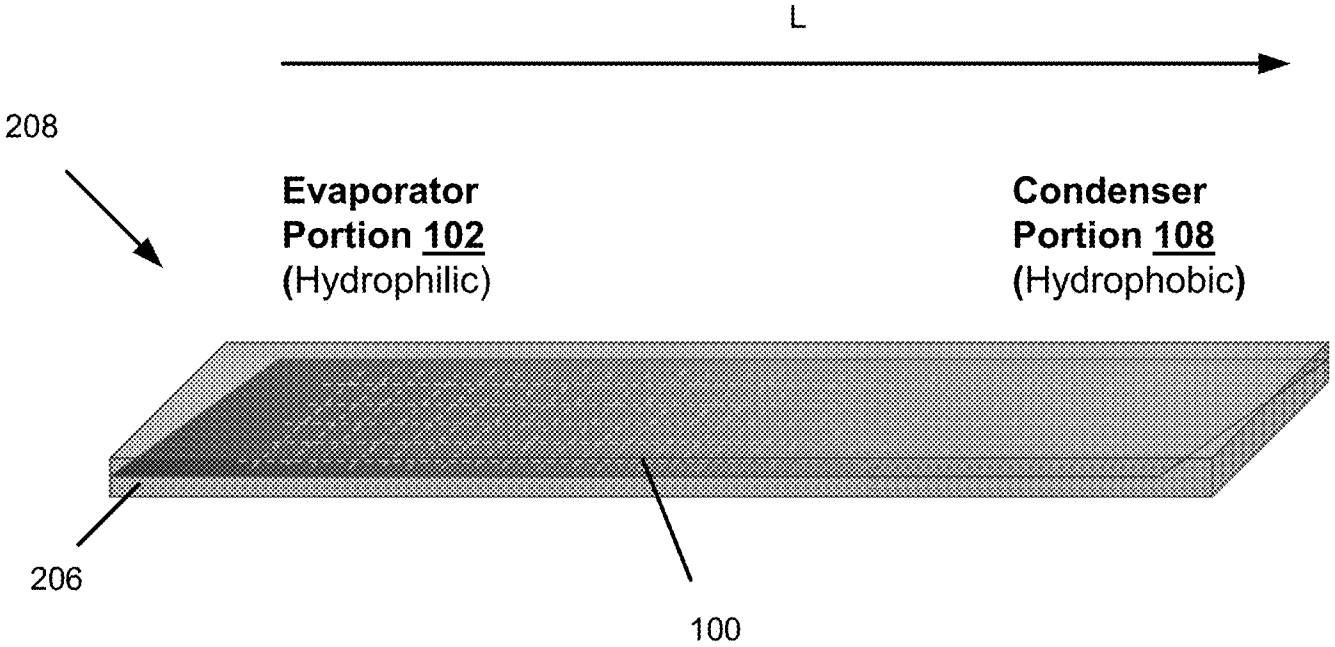

The techniques, systems, and arrangements described herein provide heat pipes and vapor chambers manufactured using simplified unique heat pipe fabrication techniques, whereby wettability of surfaces (hydrophilicity and hydrophobicity) of titanium (TI), titanium oxide, other alloys of titanium or other metals (e.g., copper, aluminum, and stainless steel) may be modulated and controlled through laser treatment nano or pico second laser and then post vacuum processes.

In particular, metal and metal oxide surfaces (e.g., Ti or a Ti Alloy) may be treated with a laser to create different patterns to show hydrophilicity across the entire surface. Then through a controlled vacuum process the surface energy and wettability of the surface may be modulated to become hydrophobic and even superhydrophobic. In some examples, the controlled vacuum process may be performed in the presence of an organic gas partial pressure.

In examples, a heat pipe includes a first substrate and an evaporator portion comprising a plurality of raised features on a surface of the first substrate. The heat pipe further includes a condenser portion including a coating of an organic compound on the surface of the first substrate. The coating of the organic compound on the surface of the first substrate in the condenser portion has a carbon content in a range of 1% to 15%. The heat pipe further includes a second substrate bonded to the first substrate and a working fluid between the first substrate and the second substrate.

In some examples, the organic compound comprises a fluorinated compound. In examples, the organic compound comprises formic acid. In some examples, the organic compound comprises methanol.

In examples, a thickness of the coating of the organic material is in a range of 0.1 microns to 2 microns.

In examples, a pitch of the raised features is in a range of 50 microns to 200 microns. In some examples, a first pitch of the raised features in the evaporator portion is in a range of 50 microns to 100 microns and a second pitch of the raised features in the condenser portion is in a range of 100 microns to 200 microns. In some examples, the first pitch increases from 50 microns to 100 microns along a longitudinal direction across the substrate and the second pitch increases from 100 microns to 200 microns in the longitudinal direction across the substrate In examples, the first substrate comprises one of titanium, titanium oxide, copper, aluminum, or titanium alloy.

In examples, an artificial reality device includes a frame wherein the frame includes at least one heat pipe, the at least one heat pipe including a first substrate and an evaporator portion including a plurality of raised features on a surface of the first substrate. The at least one heat pipe further includes a condenser portion including a coating of an organic compound on the surface of the first substrate, wherein the coating of the organic compound on the surface of the first substrate in the condenser portion has a carbon content in a range of 1% to 15%. The at least one heat pipe further includes a second substrate bonded to the first substrate and a working fluid between the first substrate and the second substrate.

In some examples, the organic compound comprises a fluorinated compound. In examples, the organic compound comprises formic acid. In some examples, the organic compound comprises methanol.

In examples, a thickness of the coating of the organic material is in a range of 0.1 microns to 2 microns.

In examples, a pitch of the raised features is in a range of 50 microns to 200 microns. In some examples, a first pitch of the raised features in the evaporator portion is in a range of 50 microns to 100 microns and a second pitch of the raised features in the condenser portion is in a range of 100 microns to 200 microns. In some examples, the first pitch increases from 50 microns to 100 microns along a longitudinal direction across the substrate and the second pitch increases from 100 microns to 200 microns in the longitudinal direction across the substrate In examples, the first substrate comprises one of titanium, titanium oxide, copper, aluminum, or titanium alloy.

In examples, an artificial reality device includes at least one heat pipe, wherein the at least one heat pipe includes an evaporator portion comprising a plurality of raised features on a surface of a substrate. The at least one heat pipe also includes a condenser portion including a coating of an organic compound on the surface of the first substrate, wherein the coating of the organic compound on the surface of the substrate in the condenser portion has a carbon content in a range of 1% to 15%. The at least one heat pipe further includes a working fluid.

In examples, a method of making a substrate for a heat pipe or vacuum chamber may include providing a substrate including a plurality of raised features on a surface of the substrate. In examples, the surface of at least a first section of the substrate may be masked. In examples, the substrate may be placed in a vacuum chamber and a chemical vapor deposition (CVD) may be applied to the substrate while the substrate is under vacuum to create a hydrophobic surface at a second section of the substrate. In examples, the substrate is removed from the vacuum chamber and the mask is removed.

In some examples, the CVD deposits an organic compound on the substrate. In some examples, the CVD deposits a fluorinated compound on the substrate. In examples, the CVD deposits formic acid on the substrate. In some examples, the CVD deposits methanol on the substrate.

In examples, a pressure of the vacuum is in a range of about 1 to 5 pascals. In examples, an amount of time for subjecting the substrate to CVD while the substrate is under vacuum is in a range of about 15 to 120 minutes. In some examples, the amount of time is greater than about 90 minutes. In examples, the amount of time is inversely proportional to an amount of vacuum pressure of the vacuum chamber.

In examples, a thickness of a coating deposited by the CVD is in a range of 0.1 microns to 2 microns.

In examples, a pitch of the raised features is in a range of 50 microns to 200 microns. In some examples, a first pitch of the raised features in the first section is in a range of 50 microns to 100 microns and a second pitch of the raised features in the second section of the substrate is in a range of 100 microns to 200 microns. In some examples, the first pitch increases from 50 microns to 100 microns along a longitudinal direction across the substrate and the second pitch increases from 100 microns to 200 microns in the longitudinal direction across the substrate.

In examples, the method further includes imparting a gradient of hydrophobicity of the second section of the substrate by one or more of (i) adjusting a pressure of the vacuum over time, (ii) adjusting a concentration of a compound deposited by the CVD over time or over a dimension of the substrate, (iii) adjusting a pitch of the raised features in the second section of the substrate along a dimension of the second section, or (iv) adjusting an amount of time for which the substrate is subjected to the CVD while the substrate is under at least the partial vacuum, wherein the second section is different from the first section.

In examples, the substrate comprises one of titanium, titanium oxide, copper, aluminum, or titanium alloy.

In examples, the method further includes enclosing at least the surface of the substrate within a sealed housing with a working fluid to form at least one of a heat pipe or vapor chamber. For example, upon assembly of a heat pipe or vapor chamber, the interior of the heat pipe or vapor chamber may be evacuated to obtain a near vacuum (e.g., having pressure less than about $10^{-3}$ Torr in some examples). In examples, a small amount of water or other working fluid (e.g., 0.1 grams to 1 gram in some examples) may be introduced into the interior of the heat pipe or vapor chamber. In examples, the working fluid may be introduced after the heat pipe or vapor chamber has been evacuated to near vacuum. In examples, the working fluid may be water, acetone, ammonia, glycol/water solution, dielectric coolants, alcohols, liquid nitrogen, mercury, magnesium, potassium, sodium, lithium, silver, methanol, or any combination thereof.

Example Embodiments

FIG. 1 schematically illustrates a substrate 100 for a heat pipe or vapor chamber (which may be referred to herein collectively as heat pipes). The substrate 100 is illustrated as an elongated substrate or rectangle. However, the substrate 100 may be sized and shaped to any desired dimensions for a given design architecture. By way of example and not limitation, a heat pipe or vapor chamber may be elongated, arcuate, curved with continuous or variable radii, substantially planar substrates. In examples, the substrate 100 comprises one of titanium, titanium oxide, copper, aluminum, or titanium alloy. However, in other examples, any of the other materials described herein may be used.

The substrate 100 includes a first portion or section that serves as an evaporator portion 102 in a heat pipe or vapor chamber and has a hydrophilic surface 104. The evaporator portion 102 includes raised features 106. In some examples, channels may be defined within the evaporator portion 102 to provide protrusions similar to the raised features.

The substrate 100 also includes a second portion or section that that serves as a condenser portion 108 in a heat pipe or vapor chamber and has a hydrophobic surface 110. The condenser portion 108 includes raised features 106. In some examples, channels may be defined within the condenser portion 102 to provide protrusions similar to the raised features.

In examples, one or more raised features 106 may be formed only over a portion (less than all) of the substrate 100. In examples, one or more raised features 106 may be formed over the whole surface of the substrate 100. In examples, one or more raised features 106 may be formed to extend along the full length of the surfaces 104, 110 of the substrate 100. In examples, one or more raised features 106 may be formed to extend only partially along a length (less than the full length) of the surfaces 104, 110 of the substrate 100. In examples, one or more raised features may extend partially along the length (less than the full length) of the surfaces 104, 110 of the substrate 100 and other one or more raised features 106 may extend along the full length of the surfaces 104, 110 of the substrate 100.

In examples, a pitch of the raised features 106 is in a range of 50 microns to 200 microns. In some examples, a pitch of the raised features 106 in the evaporator portion 102 is in a range of 50 microns to 100 microns and a pitch of the raised features in the condenser portion 108 is in a range of 100 microns to 200 microns. In some examples, the pitch of the raised features 106 in the evaporator portion 102 increases from 50 microns to 100 microns along a longitudinal direction L across the substrate 100 and the pitch of the raised features in the condenser portion 108 increases from 100 microns to 200 microns in the longitudinal direction L across the substrate.

In some examples, the raised features 106 may be created using a laser process. Additionally, an oxidation process may be performed on and/or between the raised features 106 to form an oxide. In some examples, the raised features 106 may be created using techniques, systems, and processes as described in co-pending U.S. patent application Ser. No. 17/559,949, assigned to Meta Platforms Technologies, LLC, Menlo Park, CA, the entirety of which is incorporated herein by reference for all purposes.

In particular, in the evaporator portion 102, metal oxides exposed to air (thin passivation layers or those formed by the laser processing), have unsaturated metal and oxygen atoms in their surface. Therefore, the hydroxylation may take place mainly by the adsorption of atmospheric water (heterolytic dissociation). This is a reason for the hydrophilic nature of most of the metallic surfaces in the evaporator portion 102, and also the freshly prepared laser patterned raised features 106. In examples, the hydrophilic surface 104 of the evaporator portion 102 has a low contact angle, e.g., less than about 40 degrees.

Referring to FIGS. 2A-2D, in examples, the raised features 106 are created using a laser process with a laser 200, as previously noted. After the raised features 106 are created, at least surface 104 of the evaporator portion 102 may be masked with protective mask 202. After the evaporator portion 102 is masked, the substrate 100 may be placed in a vacuum chamber 204. Once the substrate 100 is placed in the vacuum chamber 204, a chemical vapor deposition (CVD) of an organic compound may be applied to the substrate 100 while the substrate 100 is under vacuum in the vacuum chamber 204 to create hydrophobic surface 110.

In particular, adsorption of organic molecules reaches a higher efficiency under vacuum since the water amount is much lower than that at normal atmospheric pressure. Thus, more reaction centers on the surface (OH groups or Ti4+ atoms) remain active for the adsorption of organic molecules. Therefore, the surface 110 becomes more hydrophobic. The amount of hydrocarbons may be controlled by introducing partial pressure of organic gases, e.g., formic acid, methanol, fluorinated compounds, etc. The partial pressure may be in a range 0.05 to 0.5 Pa. The surface carbon content is higher for the laser-structured metal samples aged under an organic-rich atmosphere and partial vacuum. The carbon content on the surface 110 in the condenser portion 108 after the vacuum process is in a range of 1% 10 15%.

In some examples, the CVD deposits an organic compound on the substrate 100. In some examples, the CVD deposits a fluorinated compound on the substrate 100. In examples, the CVD deposits formic acid on the substrate 100. In some examples, the CVD deposits methanol on the substrate 100. In examples, a thickness of a coating on the substrate 100 deposited by the CVD is in a range of 0.1 microns to 2 microns.

In examples, a pressure of the vacuum in the vacuum chamber 204 is in a range of about 1 to 5 pascals. In examples, an amount of time for subjecting the substrate 100 to CVD while the substrate 100 is under vacuum is in a range of about 15 to 120 minutes. In some examples, the amount of time is greater than about 90 minutes. In examples, the amount of time is inversely proportional or otherwise inversely related to an amount of vacuum pressure of the vacuum chamber 204.

Thus, a first operation includes a laser process using the laser 200 to create a hydrophilic surface for all or a portion of the "floor plan" on the substrate 100, e.g., the evaporator portion 102 and the condenser portion 108, by creating the raised features 106. In examples, a second operation includes masking at least surface 104 of the evaporator portion 102 with a protective mask 202 to protect the evaporator portion 102 from a CVD process. In examples, a third operation includes placing the substrate 100 in the vacuum chamber 204 and applying a CVD of an organic compound to the substrate 100 while the substrate 100 is under vacuum in the vacuum chamber 204. By adding an organic compound (e.g., a fluorinated compound, formic acid, methanol, etc.), the hydrophobicity of the surface 110 of the condenser portion 108 may be modulated. In examples, the hydrophobic surface 110 of the condenser portion 108 has a high contact angle, e.g., greater than about 110 degrees.

In some examples, the protective mask 202 may vary along the longitudinal direction L such that the hydrophobicity may increase gradually from the evaporator portion 102 to the condenser portion 108. In examples, the variability of the protective mask 202 may be with respect to thickness of the protective mask 202, permeability of the protective mask 202 to the organic gas, porosity, etc. In examples, a gradient of hydrophilicity to hydrophobicity from the evaporator portion 102 to the condenser portion 108 along the longitudinal direction L may be imparted by one or more of (i) adjusting a pressure of the vacuum over time, (ii) adjusting a concentration of a compound deposited by the CVD over time or over a dimension of the substrate 100, (iii) adjusting a pitch of the raised features 106 in the condenser portion 108 of the substrate 100, or (iv) adjusting an amount of time for which the substrate 100 is subjected to the CVD while the substrate 100 is under at least partial vacuum.

In examples, the protective mask 202 may be eliminated and only the condenser portion 108 of the substrate 100 may be placed in the vacuum chamber 204 and subjected to CVD under vacuum.

Once the CVD process is complete, the substrate 100 may be removed from the vacuum chamber 204. The protective mask 202 may be removed. In some examples, one or more other processing operations, e.g., surface cleaning using isopropyl alcohol (IPA) or acetone, may be performed on the substrate 100. A second substrate 206 may be bonded to the substrate 100 over at least the raised features 106 to provide a sealed housing. In examples, the second substrate 206 may comprise comprises one of titanium, titanium oxide, copper, aluminum, or titanium alloy. A working fluid (not illustrated) is disposed in between the substrates 100, 206 to form a heat pipe or vacuum chamber 208. For example, upon assembly of a heat pipe or vapor chamber 208, the interior of the heat pipe or vapor chamber 208 may be evacuated to obtain a near vacuum (e.g., having pressure less than about $10^{-3}$ Torr in some examples). In examples, a small amount of water or other working fluid (e.g., 0.1 grams to 1 gram in some examples) may be introduced into the interior of the heat pipe or vapor chamber 208. In examples, the working fluid may be introduced after the heat pipe or vapor chamber 208 has been evacuated to near vacuum. In examples, the working fluid may be water, acetone, ammonia, glycol/water solution, dielectric coolants, alcohols, liquid nitrogen, mercury, magnesium, potassium, sodium, lithium, silver, methanol, or any combination thereof.

Example Devices Including a Heat Pipe or Vacuum Chamber

Figure 3:
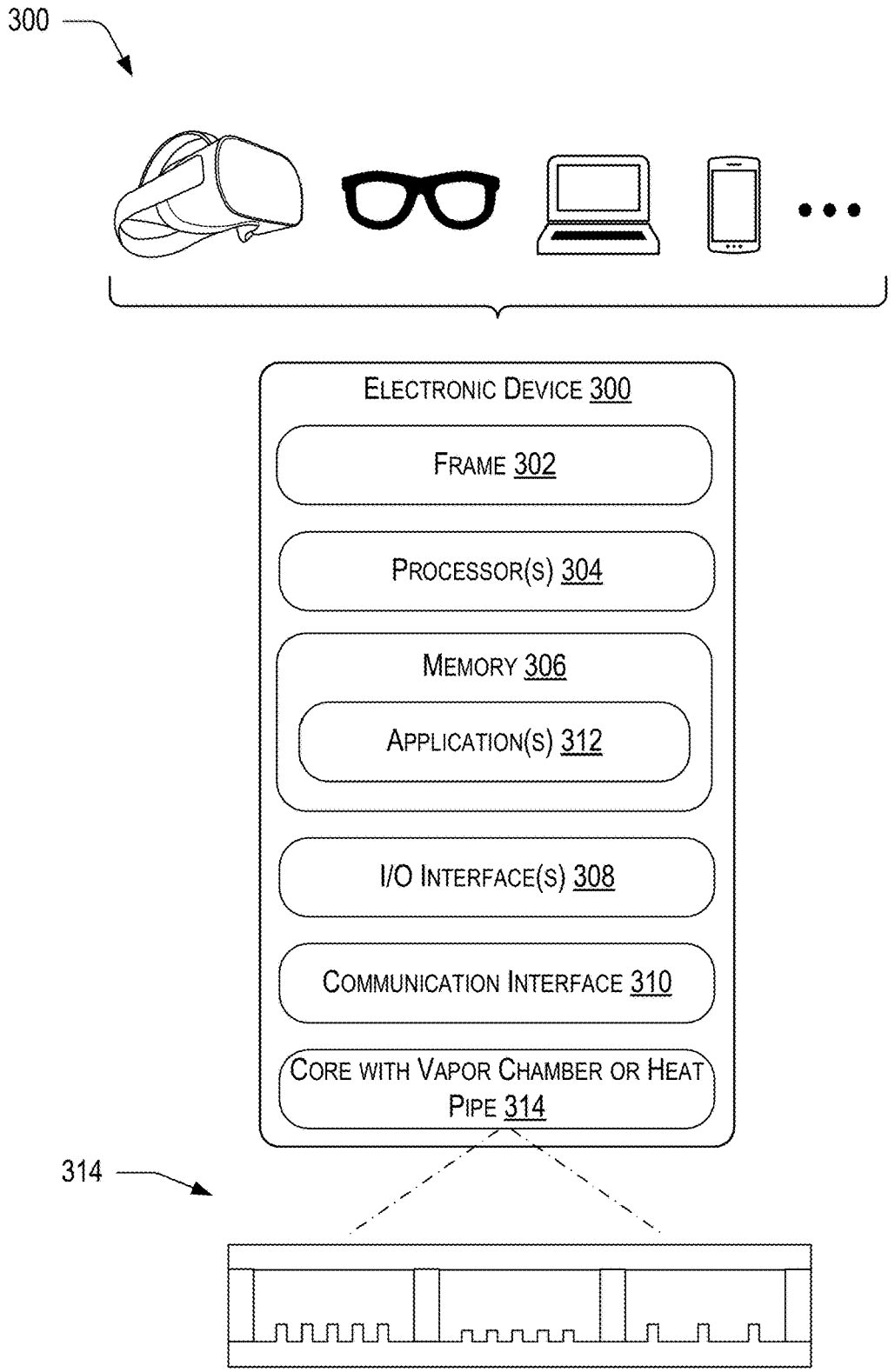
FIG. 3 is a simplified schematic diagram of an example structure incorporating a heat pipe or vapor chamber, in accordance with an example of the present disclosure.

FIG. 3 illustrates an example electronic device 300 in which a heat pipe or vapor chamber as manufactured in accordance with this description may be employed. The electronic device 300 may include a frame or housing 302 for one or more electronic components. The electronic device 300 may be representative of a head-mounted device, such as an artificial reality, augmented reality, and/or extended reality visor or glasses, a laptop computer, a mobile device such as a tablet or mobile phone, or any other electronic device such as those described throughout this application. As shown, the electronic device 300 includes one or more electronic components such as processor(s) 304, memory 306, input/output interfaces 308 (or "I/O interfaces 308"), and communication interfaces 308, which may be communicatively coupled to one another by way of a communication infrastructure (e.g., a bus, traces, wires, etc.). While the electronic device 300 is shown in FIG. 3 having a particular configuration, the components illustrated in FIG. 3 are not intended to be limiting. The various components can be rearranged, combined, and/or omitted depending on the requirements for a particular application or function. Additional or alternative components may be used in other examples.

In some examples, the processor(s) 304 may include hardware for executing instructions, such as those making up a computer program or application. For example, to execute instructions, the processor(s) 304 may retrieve (or fetch) the instructions from an internal register, an internal cache, the memory 306, or other computer-readable media, and decode and execute them. By way of example and not limitation, the processor(s) 304 may comprise one or more central processing units (CPUs), graphics processing units (GPUs), holographic processing units, microprocessors, microcontrollers, integrated circuits, programmable gate arrays, or other hardware components usable to execute instructions.

The memory 306 is an example of computer-readable media and is communicatively coupled to the processor(s) 304 for storing data, metadata, and programs for execution by the processor(s) 304. In some examples, the memory 306 may constitute non-transitory computer-readable media such as one or more of volatile and non-volatile memories, such as Random-Access Memory ("RAM"), Read-Only Memory ("ROM"), a solid-state disk ("SSD"), Flash, Phase Change Memory ("PCM"), or other types of data storage. The memory 306 may include multiple instances of memory, and may include internal and/or distributed memory. The memory 306 may include removable and/or non-removable storage. The memory 306 may additionally or alternatively include one or more hard disk drives (HDDs), flash memory, Universal Serial Bus (USB) drives, or a combination these or other storage devices.

As shown, the electronic device 300 includes one or more I/O interfaces 308, which are provided to allow a user to provide input to (such as touch inputs, gesture inputs, keystrokes, voice inputs, etc.), receive output from, and otherwise transfer data to and from the electronic device 300. Depending on the particular configuration and function of the electronic device 300, the I/O interface(s) 308 may include one or more input interfaces such as keyboards or keypads, mice, styluses, touch screens, cameras, microphones, accelerometers, gyroscopes, inertial measurement units, optical scanners, other sensors, controllers (e.g., handheld controllers, remote controls, gaming controllers, etc.), network interfaces, modems, other known I/O devices or a combination of such I/O interface(s) 308. Touch screens, when included, may be activated with a stylus, finger, thumb, or other object. The I/O interface(s) 308 may also include one or more output interfaces for presenting output to a user, including, but not limited to, a graphics engine, a display (e.g., a display screen, projector, holographic display, etc.), one or more output drivers (e.g., display drivers), one or more audio speakers, and one or more audio drivers. In certain examples, I/O interface(s) 308 are configured to provide graphical data to a display for presentation to a user. The graphical data may be representative of one or more graphical user interfaces and/or any other graphical content as may serve a particular implementation. By way of example, the I/O interface(s) 308 may include or be included in a wearable device, such as a head-mounted display (e.g., headset, glasses, helmet, visor, etc.), a suit, gloves, a watch, or any combination of these, a handheld electronic device (e.g., tablet, phone, handheld gaming device, etc.), a portable electronic device (e.g., laptop), or a stationary electronic device (e.g., desktop computer, television, set top box, a vehicle electronic device). In some examples, the I/O interface(s) 308 may be configured to provide an artificial reality, augmented reality, and/or extended reality environment or other computer-generated environment.

The electronic device 300 may also include one or more communication interface(s) 310. The communication interface(s) 310 can include hardware, software, or both. In examples, communication interface(s) 310 may provide one or more interfaces for physical and/or logical communication (such as, for example, packet-based communication) between the electronic device 300 and one or more other electronic devices or one or more networks. As an example, and not by way of limitation, the communication interface(s) 310 may include a network interface controller (NIC) or network adapter for communicating with an Ethernet or other wire-based network and/or a wireless NIC (WNIC) or wireless adapter for communicating with a wireless network, such as a WI-FI adapter. In examples, communication interface(s) 310 can additionally include a bus, which can include hardware (e.g., wires, traces, radios, etc.), software, or both that communicatively couple components of electronic device 300 to each other. In examples, the electronic device 300 may include additional or alternative components that are not shown, such as, but not limited to, a power supply (e.g., batteries, capacitors, etc.), a housing or other enclosure to at least partially house or enclose the chassis and/or any or all of the components.

The memory 306 may store one or more applications 312, which may include, among other things, an operating system (OS), productivity applications (e.g., word processing applications), communication applications (e.g., email, messaging, social networking applications, etc.), games, or the like. The application(s) 312 may be implemented as one or more stand-alone applications, as one or more modules of an application, as one or more plug-ins, as one or more library functions application programming interfaces (APIs) that may be called by other applications, and/or as a cloud-computing model. The application(s) 312 can include local applications configured to be executed locally on the electronic device, one or more web-based applications hosted on a remote server, and/or as one or more mobile device applications or "apps."

In examples, the electronic device 300 may also include a core 314 including one or more heat pipes or vapor chambers to which the other electronic components such as the processor(s) 304, memory 306, I/O interface(s) 308, and/or communication interface(s) 310 can be coupled. In examples, the heat pipe or vapor chamber may be formed integrally with the core 314 and may be configured to dissipate and/or spread heat generated by the one or more other components.

In examples, the heat pipe or vapor chamber of the core 314 can be made according to the techniques described herein, and may be configured to exhibit manufacturing tolerances suitable for mounting precision optical components (e.g., lenses, display screens, mirrors, gratings, optical fibers, light pipes, etc.).

Example Method

Figure 4:
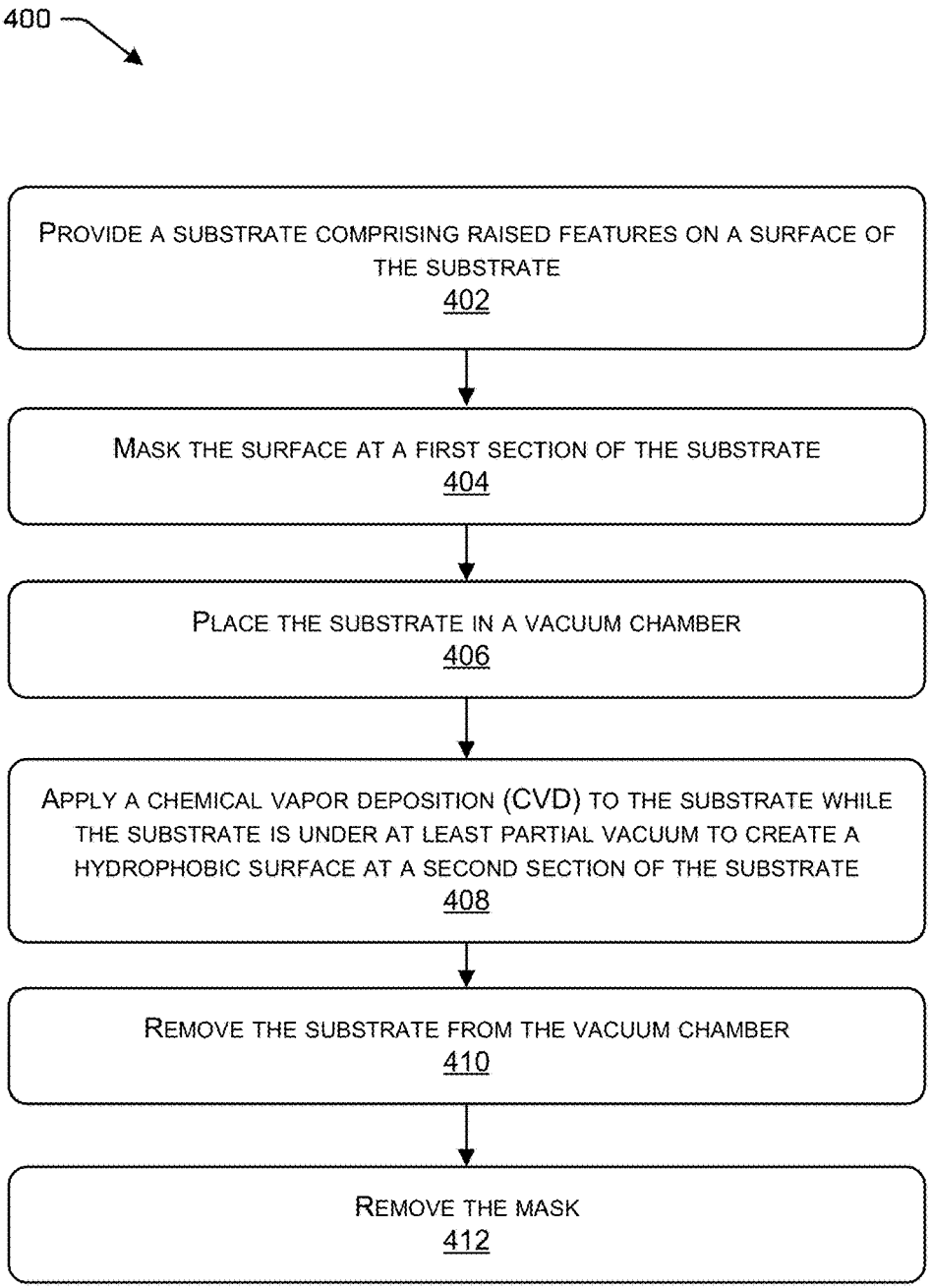
FIG. 4 illustrates a flow diagram of an example method that illustrates aspects of techniques in accordance with examples as described herein.

FIG. 4 illustrates a flow diagram of an example method 400 that illustrates aspects of techniques as described herein. It should be appreciated that more or fewer operations might be performed than shown in FIG. 4 and described herein. These operations can also be performed in parallel, or in a different order than those described herein.

FIG. 4 schematically illustrates an example method 400 of manufacturing a substrate for a heat pipe or vapor chamber, e.g., heat pipe or vacuum chamber 208 including substrate 100.

At 402, a substrate comprising raised features on a surface of the substrate is provided. In some examples, the substrate 100 for a heat pipe or vapor chamber is provided. In examples, the substrate 100 comprises one of titanium, titanium oxide, copper, aluminum, or titanium alloy.

At 404, a surface at a first section of the substrate is masked. For example, at least the surface 104 of the evaporator portion 102 may be masked with a protective mask 202 to protect the evaporator portion 102 from a CVD process.

At 406, the substrate is placed in a vacuum chamber. For example, the substrate 100 in the vacuum chamber 204.

At 408, a chemical vapor deposition (CVD) is applied to the substrate while the substrate is under at least partial vacuum to create a hydrophobic surface at a second section of the substrate. For example, a CVD of an organic compound to the substrate 100 while the substrate 100 is under vacuum in the vacuum chamber 204. In examples, a pressure of the vacuum in the vacuum chamber 204 is in a range of about 1 to 5 pascals. In examples, an amount of time for subjecting the substrate 100 to CVD while the substrate 100 is under vacuum is in a range of about 15 to 120 minutes. In some examples, the amount of time is greater than about 90 minutes. In examples, the amount of time is inversely proportional to an amount of vacuum pressure of the vacuum chamber 204. By adding an organic compound (e.g., a fluorinated compound, formic acid, methanol, etc.), the hydrophobicity of the surface 110 of the condenser portion 108 may be modulated. In examples, the hydrophobic surface 110 of the condenser portion 108 has a high contact angle, e.g., greater than about 110 degrees.

At 410, the substrate is removed from the vacuum chamber.

At 412, the mask is removed.

CONCLUSION

Although the discussion above sets forth example implementations of the described techniques, other architectures may be used to implement the described functionality and are intended to be within the scope of this disclosure.

Furthermore, although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A heat pipe, comprising:
- a first substrate;
- an evaporator portion comprising a plurality of raised features on a surface of the first substrate;
- a condenser portion including a coating of an organic compound on the surface of the first substrate, wherein the coating of the organic compound on the surface of the first substrate in the condenser portion has a carbon content in a range including 1% to 5%;
- a second substrate bonded to the first substrate; and
- a working fluid between the first substrate and the second substrate.

2. The heat pipe of claim 1, wherein the organic compound comprises a fluorinated compound.

3. The heat pipe of claim 1, wherein the organic compound comprises formic acid.

4. The heat pipe of claim 1, wherein the organic compound comprises methanol.

5. The heat pipe of claim 1, wherein a thickness of the coating of the organic compound is in a range of about 0.1 microns to 2 microns.

6. The heat pipe of claim 1, wherein a pitch of the raised features is in a range of 50 microns to 200 microns.

7. The heat pipe of claim 6, wherein:
- a first pitch of the raised features in the evaporator portion is in a range of 50 microns to 100 microns; and
- a second pitch of the raised features in the condenser portion is in a range of 100 microns to 200 microns.

8. The heat pipe of claim 7, wherein:
- the first pitch increases from 50 microns to 100 microns along a longitudinal direction across the heat pipe; and
- the second pitch increases from 100 microns to 200 microns along the longitudinal direction across the heat pipe.

9. The heat pipe of claim 1, wherein the first substrate comprises one of titanium, titanium oxide, copper, aluminum, or titanium alloy.

10. An artificial reality device comprising a frame, wherein the frame comprises at least one heat pipe comprising:
- a first substrate;
- an evaporator portion comprising a plurality of raised features on a surface of the first substrate;
- a condenser portion including a coating of an organic compound on the surface of the first substrate, wherein the coating of the organic compound on the surface of the first substrate in the condenser portion has a carbon content in a range including 1% to 5%;
- a second substrate bonded to the first substrate; and
- a working fluid between the first substrate and the second substrate.

11. The artificial reality device of claim 10, wherein the organic compound comprises a fluorinated compound.

12. The artificial reality device of claim 10, wherein the organic compound comprises formic acid.

13. The artificial reality device of claim 10, wherein the organic compound comprises methanol.

14. The artificial reality device of claim 10, wherein a thickness of the coating of the organic compound is in a range of about 0.1 microns to 2 microns.

15. The artificial reality device of claim 10, wherein a pitch of the raised features is in a range of 50 microns to 200 microns.

16. The artificial reality device of claim 15, wherein:
- a first pitch of the raised features in the evaporator portion is in a range of about 50 microns to 100 microns; and a second pitch of the raised features in the condenser portion is in a range of about 100 microns to 200 microns.

17. The artificial reality device of claim 16, wherein:

the first pitch increases from 50 microns to 100 microns along a longitudinal direction across the heat pipe; and the second pitch increases from 100 microns to 200 microns along the longitudinal direction across the heat pipe.

18. The artificial reality device of claim 10, wherein the first substrate comprises one of titanium, titanium oxide, copper, aluminum, or titanium alloy.

19. An artificial reality device comprising at least one heat pipe, wherein the heat pipe comprises:

an evaporator portion comprising a plurality of raised features on a surface of a substrate;

a condenser portion including a coating of an organic compound on the surface of the substrate, wherein the coating of the organic compound on the surface of the substrate in the condenser portion has a carbon content in a range including 1% to 5%; and a working fluid.

20. The artificial reality device of claim 19, wherein the artificial reality device comprises one of a visor, glasses, a laptop computer, or a mobile device.

* * * * *